United States Patent [19]

Schachter

[11] 4,259,127

[45] Mar. 31, 1981

[54] METHOD OF WEATHER-PROOFING SURFACES PARTICULARLY CONCRETE ROOFS

[75] Inventor: Haim Schachter, Givataim, Israel

[73] Assignee: Tanis Ltd., Holon, Israel

[21] Appl. No.: 867,395

[22] Filed: Jan. 6, 1978

[30] Foreign Application Priority Data

Oct. 28, 1977 [IL] Israel ..... 53251

[51] Int. Cl.[3] ..... C09J 3/30; B32B 11/04; B32B 13/04; E04F 13/18

[52] U.S. Cl. ..... 156/71; 52/746; 106/278; 156/337; 428/212; 428/217; 428/280; 428/282; 428/454; 428/489

[58] Field of Search ..... 156/71, 337; 428/489, 428/212, 217, 280, 282, 454; 106/278; 52/746

[56] References Cited

U.S. PATENT DOCUMENTS

| | | | |
|---|---|---|---|
| 2,131,085 | 9/1938 | Anderton | 106/278 |
| 2,481,370 | 9/1949 | van den Berge | 428/489 |
| 2,939,794 | 6/1960 | Wilkinson | 106/278 X |
| 3,712,832 | 1/1973 | Stapleford | 156/337 X |
| 3,940,540 | 2/1976 | Schmidt | 156/337 X |

OTHER PUBLICATIONS

Julius Grant (Ed.) "Hackh's Chemical Dictionary", 4th Ed. (1969), pp. 64, 525.

*Primary Examiner*—William A. Powell
*Assistant Examiner*—Robert A. Dawson
*Attorney, Agent, or Firm*—Benjamin J. Barish

[57] ABSTRACT

A method of weather-proofing surfaces, particularly concrete roofs, is described wherein first applied is an inner layer of a soft asphalt (bitumen) having a softening point of 100°-140° F. and including reinforcing fibers, and then an overlying layer of an asphalt-saturated-felt. In one preferred example, the overlying layer is a glass-fiber mat saturated with a hard air-blown asphalt having a softening point of at least 180° F.; and in a second described example, it is paper saturated with soft (non-blown) asphalt and coated on its outer faces with the hard air-blown asphalt. The combination of the soft asphalt inner layer and the asphalt-saturated-felt outer layer has been found to produce a barrier impermeable to water travelling inwardly, but permeable to vapor travelling outwardly thereby avoiding the formation of blisters. This combination has been further found to be suitable for surfaces having extremely high slopes, even perfectly vertical surfaces, without the need for mechanical fastening devices.

9 Claims, No Drawings

METHOD OF WEATHER-PROOFING SURFACES PARTICULARLY CONCRETE ROOFS

BACKGROUND OF THE INVENTION

The present invention relates to a method of weatherproofing surfaces, particularly roofs, and to surfaces weatherproofed in accordance with the method. The invention is particularly useful in cold-process roofing, and is therefore described below with respect to this application.

Cold-process roofing, which has been used for many years particularly in the United States of America, is a process for applying a built-up asphalt (bitumen) roof without the necessity of heating the asphalt on the job. In this process, a cold-process cement is used for bonding one or more plies of an asphalt-saturated-felt to the roof. The asphalt-saturated-felt used in this process must meet a number of requirements: Thus, it must provide an outer surface which is hard or to which a top surface material, if used, will firmly adhere; it must provide a surface to which the cold-process cement will also firmly adhere; and it must allow the solvent of the cold-process cement to evaporate through it so that the cement sets up properly to form a tight water-proof bond. The cold-process cement must also meet certain requirements: Thus, it must be of a material which can be easily applied to form a continuous film; it must firmly bond a ply of a cold-processed felt to the roof deck, and additional plies together if a plurality of plies are used; and it must set-up rapidly, that is within 24 hours under normal spring or fall weather conditions, to firmly bond the felt against slippage.

To meet these requirements, the cold-process felt, which may be of mineral fibers (e.g., asbestos, glass) or of organic fibers (e.g., paper, rags, wood), and which is sometimes called a mat particularly when of fiber-glass, is usually saturated with asphalt such as to have an outer surface of a hard asphalt, e.g., one having a softening point (sometimes referred to as Ball and Ring Number) of at least 180° F. This may be done by saturating the felt with the hard asphalt material, or saturating it with a soft asphalt material and providing outer face coatings of the hard asphalt material. The cold process cement used is usually a hard asphalt (typically an air-blown asphalt of 195° F. softening point) present to about 50% by weight of the total composition, mineral fibers present to about 10% by weight, and a solvent (usually 300°-400° F. boiling range naphtha) present to about 40% by weight. Providing a hard, high softening point asphalt in such cold-process cements is usually considered necessary to prevent the roofing from slipping or sliding, and even then the maximum acceptable slope for such roofings is considered to be two inches per foot, unless mechanical fastening devices are used to supplement the holding of the cement itself.

In addition to the maximum slope permissible in the use of such cold-process cements, these cements also form a tight membrane film which is very low in moisture vapor transmission. The roofing is therefore subject to blistering by moisture trapped below the roofing. This problem is particularly serious when the roofing is applied to concrete surfaces where vapor is released from the concrete for a long drying-out period.

A number of techniques have been developed in an attempt to counteract the above-mentioned blistering problem, but these techniques have not proved entirely satisfactory. Thus, water emulsions of the asphalt have been developed, but these have been found feasible for top surfacing only; moreover since they are water-based materials, they are subject to freezing at low temperatures, and to washing-off by rain before they are thoroughly set. Roofings have also been devised including regularly-spaced adhesion points, rather than continuously bonded films, to permit the escape of vapor and thereby to prevent blistering; but such techniques are usually expensive to apply, and moreover, they have not successfully overcome the maximum-slope limitation mentioned above.

OBJECTS AND SUMMARY OF THE PRESENT INVENTION

An object of the present invention is to provide a method of weatherproofing surfaces particularly, but not only, applicable to the cold-process roofing system, which method produces advantages in the above respects. More particularly, an object of the present invention is to provide a method of weatherproofing surfaces which substantially avoids the formation of blisters and which may be used on surfaces having extremely high slopes, even perfectly vertical surfaces.

According to one aspect of the invention, there is provided a method of weatherproofing a surface comprising applying to the surface an inner layer of a cold coating mixture including a soft asphalt having a softening point of 100°-140° F., reinforcing fibers and a solvent to reduce the viscosity of the mixture to coatable consistency; and adhering to the inner layer an overlying felt layer.

In the preferred embodiments of the invention described below, the soft asphalt of the inner layer is non-air-blown, steam-refined asphalt, and the overlying felt layer includes outer surfaces of a hard, air-blown asphalt having a softening point of at least 180° F.

In one embodiment of the invention described below, the overlying felt layer is a glass mat saturated with the hard air-blown asphalt; and in a second described embodiment, it is of paper saturated with soft (non-blown) asphalt having a softening point of 100°-140° F. and coated on its outer faces with the hard air-blown asphalt.

As mentioned earlier, the invention is particularly applicable to the cold process roofing system in which the inner layer is applied as a cold coating mixture including the soft asphalt, reinforcing fibers, and a solvent to reduce the viscosity of the mixture to coatable consistency. Particularly good results have been produced when the latter coating comprises by weight: 60-65% of non-air-blown asphalt having a softening point of 120°-130° F.; 15-20% by weight of reinforcing fibers and stabilizers; and 15-20% by weight of a solvent having a boiling point of 300°-440° F.

A roof or other surface, e.g. outer side wall, weatherproofed in accordance with the above method provides a number of important advantages: First, the combination of the soft asphalt inner layer and the asphalt-saturated-felt outer layer apparently produces a barrier which is impermeable to water travelling inwardly but is permeable to moisture vapor travelling outwardly since no blistering was noted in such roofs even after severe testing conditions of rain and heat on concrete surfaces. Moreover, it has been found that the process can be applied to a roof or other surface of any slope, even one perfectly vertical, without the need of mechanical devices to prevent slippage. Further, the soft inner asphalt layer was found to remain pliable, flexible and ductile, holding the asphalt-saturated-felt firmly bound to it, even after long periods of time.

DESCRIPTION OF PREFERRED EMBODIMENTS

Following is an example of the manner in which the above method has been successfully practiced:

EXAMPLE 1

First, the surface to be weather-proofed, in this case a concrete roof, was coated with an inner layer of the following composition, the parts being by weight:

| | | |
|---|---|---|
| (a) | Asphalt (non-air-blown, steam-refined) having a softening point of 120–130° F. | 65% |
| (b) | Asbestos fiber | 10% |
| (c) | Mineral stabilizer (calcium carbonate) | 7% |
| (d) | Naphtha (boilding point 350° F.) | 18% |

The foregoing composition was evenly spread over the concrete surface. Immediately thereafter, there was applied a layer of an asphalt-saturated-felt constituted of a fiber-glass mat saturated with a hard asphalt (air-blown) having a softening point of 180° F.

The foregoing procedure was applied to a number of concrete surfaces of varying slopes including those having a slope greater than two inches per foot, even surfaces perfectly vertical, and it was found that the underlying soft asphalt layer firmly held the asphalt-saturated-felt against slippage without any mechanical fastening devices. Further, no blistering was noted even when the process was applied to aerated or blown concrete surfaces which release water for a long period of time after setting, thereby indicating that the roofing was permeable to water vapor. Nor was blistering or leakage noted when the roofing was subjected to many months of intervening rain and hot-sun conditions, further indicating its impermeability to water from the outward direction, but its permeability to water vapor from the inward direction. Further, the soft asphalt inner layer was found to remain pliable, flexible and ductile during the complete period of testing.

Following is a second example of the manner in which the above method may be practiced:

EXAMPLE 2

The concrete roof may be coated with an inner layer of the same composition as described above in Example 1, and over it there may be applied a layer of a paper felt saturated with soft asphalt (non-air-blown, steam-refined) having a softening point of 120° F., and coated on its outer faces with a hard (air-blown) asphalt having a softening point of 200° F.

A multiple-ply roofing may be prepared by including a plurality of the above-described asphalt-saturated-felt plies each one bonded to the under-lying one by the soft asphalt composition described above, the lowermost ply being bonded to the concrete surface by the same soft asphalt composition.

While the invention has been described with respect to the use of overlying layers of asphalt-saturated felts of fiber-glass and paper, it will be appreciated that it could also be used with respect to other asphalt-saturated felts such as of asbestos, rags and wood.

Further, while the invention has been described with respect to cold-process roofing, it will be appreciated that it could also be advantageously used in weather-proofing other surfaces, e.g. outer side walls, and using hot-process techniques.

Many other variations, modifications and applications of the invention will be apparent.

What is claimed is:

1. A method for weatherproofing a surface to provide a barrier which is substantially impermeable to water travelling inwardly but is permeable to moisture vapor travelling outwardly, which weatherproofing has sufficient tackiness so that it can be applied to surfaces of any slope without the need of mechanical fastening devices to prevent slippage, comprising: applying to the surface an inner weatherproofing layer of a cold coating mixture including a non-air-blown, steam-refined, soft asphalt having a softening point of 100°–140° F., reinforcing fibers, and a solvent to reduce the viscosity of the mixture to coatable consistency; and adhering to said inner layer an overlying felt layer.

2. The method according to claim 1, wherein the solvent is present from 15–20% by weight and has a boiling point of 300°–400° F.

3. The method according to claim 1, wherein said overlying felt layer includes outer faces of a hard, air-blown asphalt having a softening point of at least 180° F.

4. The method according to claim 3, wherein said overlying felt layer is a fiber-glass mat saturated with said hard air-blown asphalt.

5. The method according to claim 3, wherein said overlying felt layer is of paper saturated with soft asphalt having a softening point of 100°–140° F. and coated on its outer faces with said hard air-blown asphalt.

6. The method according to claim 1, wherein said cold coating mixture of the inner layer comprises, by weight: 60–65% of non-air-blown asphalt having a softening point of 120°–130° F.; 15–20% by weight of reinforcing fibers and stabilizers; and 15–20% by weight of a solvent having a boiling point of 300°–400° F.

7. The method according to claim 6, wherein said reinforcing fibers of the cold coating mixture comprise asbestos fibers.

8. The method according to claim 1, wherein said surface is concrete.

9. The method according to claim 8, wherein said concrete surface has a slope greater than two inches per foot.

* * * * *